US007854023B2

(12) United States Patent
Ando

(10) Patent No.: US 7,854,023 B2
(45) Date of Patent: Dec. 21, 2010

(54) HELMET AND METHOD OF REMOVING THE SAME

(75) Inventor: Hiroshi Ando, Sakura (JP)

(73) Assignee: Shoei Co., Ltd., Tokyo (JP)

( * ) Notice: Subject to any disclaimer, the term of this patent is extended or adjusted under 35 U.S.C. 154(b) by 901 days.

(21) Appl. No.: 11/799,912

(22) Filed: May 3, 2007

(65) Prior Publication Data

US 2007/0271688 A1 Nov. 29, 2007

(30) Foreign Application Priority Data

May 9, 2006 (JP) ..... 2006-130272

(51) Int. Cl.
*A42B 3/10* (2006.01)

(52) U.S. Cl. ..... 2/414; 2/424; 2/421

(58) Field of Classification Search ..... 2/410, 2/411, 412, 414, 421, 422, 420, 425, 427, 2/416, 417, 6.1, 6.2, 6.3
See application file for complete search history.

(56) References Cited

U.S. PATENT DOCUMENTS

| | | | | |
|---|---|---|---|---|
| 3,127,615 | A * | 4/1964 | Aileo | 2/416 |
| 4,796,309 | A * | 1/1989 | Nava | 2/414 |
| 4,916,759 | A * | 4/1990 | Arai | 2/414 |
| 5,088,129 | A * | 2/1992 | Kamata | 2/411 |
| 5,815,847 | A * | 10/1998 | Holden, Jr. | 2/418 |
| 5,953,761 | A * | 9/1999 | Jurga et al. | 2/425 |
| 6,185,753 | B1 * | 2/2001 | Arai | 2/414 |
| 6,202,223 | B1 * | 3/2001 | Chartrand | 2/410 |
| 6,256,797 | B1 * | 7/2001 | Nemoto et al. | 2/414 |
| 6,499,147 | B2 * | 12/2002 | Schiebl et al. | 2/425 |
| 7,207,071 | B2 * | 4/2007 | Pierce | 2/410 |
| 7,426,761 | B2 * | 9/2008 | Tomcany et al. | 5/628 |
| 2004/0034903 | A1 * | 2/2004 | Blair | 2/411 |
| 2008/0289085 | A1 * | 11/2008 | Bryant et al. | 2/421 |
| 2009/0031483 | A1 * | 2/2009 | Wallerberger | 2/421 |
| 2010/0095438 | A1 * | 4/2010 | Moelker | 2/418 |

FOREIGN PATENT DOCUMENTS

| | | |
|---|---|---|
| EP | 0 879 566 A2 | 11/1998 |
| JP | 2005-054300 | 3/2005 |

* cited by examiner

*Primary Examiner*—Gary L Welch
*Assistant Examiner*—Richale L Quinn
(74) *Attorney, Agent, or Firm*—Smith Gambrell & Russell LLP

(57) ABSTRACT

A helmet that can be removed from the head of a helmet wearer who wears the helmet, with a comparatively small force, and simply and quickly including preliminary operation for removal. A recess-projection fitting mechanism to attach a blockish inside pad to a head protecting cap portion includes a male hook on a blockish inside pad side, and a female hook on a head protecting cap portion side. The interrupt portion of a pad takeout member including a pulling means can interrupt between the male hook and female hook to disengage their recess-projection fitting, and can catch on the male hook, and the male hook can be pulled out to outside the head protecting cap portion at least halfway.

14 Claims, 10 Drawing Sheets

HELMET AND METHOD OF REMOVING THE SAME

TECHNICAL FIELD

The present invention relates to a helmet comprising a head protecting cap portion with one or a plurality of blockish inside pads disposed therein, at least one blockish inside pad being attached to the head protecting cap portion by one or a plurality of recess-projection fitting mechanisms, at least one recess-projection fitting mechanism comprising a male hook disposed on the at least one blockish inside pad, and a female hook disposed on the head protecting cap portion to be able to recess-projection fit with the male hook, and pulling means for extracting the at least one blockish inside pad from inside the head protecting cap portion at least partly, the pulling means being pulled to extract the at least one blockish inside pad from inside the head protecting cap portion at least partly.

The present invention also relates to a removing method of removing, from a head of a helmet wearer, a helmet comprising a head protecting cap portion with one or a plurality of blockish inside pads disposed therein, the method including attaching at least one blockish inside pad to the head protecting cap portion in advance by one or a plurality of recess-projection fitting mechanisms, when attaching the at least one blockish inside pad, using, as at least one recess-projection fitting mechanism, a mechanism comprising a male hook disposed on the at least one blockish inside pad, and a female hook disposed on the head protecting cap portion to be able to recess-projection fit with the male hook, providing in advance the helmet with pulling means for extracting the at least one blockish inside pad from inside the head protecting cap portion at least partly, when removing the helmet worn on the head of the helmet wearer, first, pulling the pulling means to extract the at least one blockish inside pad from inside the head protecting cap portion at least partly, and subsequently removing the head protecting cap portion from the head of the helmet wearer.

BACKGROUND OF THE INVENTION

A full-face-type helmet has been known. This helmet includes a full-face-type head protecting cap portion worn by the rider of a motor cycle or the like on his/her head, a shield plate capable of opening/closing the window opening formed in the front surface of the head protecting cap portion to oppose the portion between the forehead and chin of the helmet wearer, and chin straps attached to the head protecting cap portion. According to such a full-face-type helmet, almost the entire head of the helmet wearer can be protected by the head protecting cap portion.

The conventional full-face-type helmet having the above structure, however, is not easy to wear and remove from the head of wearer because the head protecting cap portion is also of a full-face type. According to recent full-face-type helmets, to improve the safety of the helmets and feeling of wearing them during a drive, the lower end portion of the head protecting cap portion is narrowed. In addition, it is heightened more to fit the head and face of the wearer due to inside pads for the cheeks and the like. Owing to this structure, when a helmet wearer, e.g., the rider of a motor cycle, has a traffic accident, e.g., a motor cycle accident, a person who takes care of the rider needs a large force to remove the full-face-type head protecting cap portion from the head of the helmet wearer. For this reasons, it is considerably difficult for one person to remove the helmet from the wearer.

This point will be described below with reference to FIG. 12. FIG. 12 shows an experiment aimed at measuring the force required to remove a full-face-type helmet 1. A bolt 4 with a ring is attached to the top portion of a full-face-type head protecting cap portion 3 of a conventional full-face-type helmet 1 worn on the head of a helmet wearer 2. The lower end of a spring balancer 5 is coupled to the bolt 4.

In the state shown in FIG. 12 (the chin straps (not shown) were unfastened from the chin of the wearer 2), the upper end of the spring balancer 5 was pulled upward. In this case, when a pair of blockish inside pads for the right and left cheeks were attached to the interior of the head protection cap portion 3, the helmet 1 could not be removed until a tension of 16 kg was applied to the top portion of the head protecting cap portion 3. In contrast to this, when the pair of blockish inside pads for the right and left cheeks were detached from the interior of the head protecting cap portion 3, the helmet 1 could be removed by applying only a tension of 2.5 kg to the top portion of the head protecting cap portion 3.

The experiment shown in FIG. 12 revealed that a large force was usually required to remove the full-face-type helmet 1, and that not so large force was required to remove the full-face-type helmet 1 when the blockish inside pads for the cheeks were detached from the interior of the head protecting cap portion 3.

On the basis of the results of the experiment shown in FIG. 12, the present applicant previously proposed the invention disclosed in EP 0 879 566 A2. According to the invention disclosed in EP 0 879 566 A2, when the rider of the motor cycle or the like wears the above-described conventional full-face-type helmet, in order to at least partly pull out the blockish inside pads for the right and left cheeks from the interior of the head protecting cap portion, right and left pull members extruded downward from these blockish inside pads are respectively attached to the blockish inside pads for the right and left cheeks. According to the helmet disclosed in EP 0 872 566 A2, a plurality of male hooks are formed on the blockish inside pads for the right and left cheeks. Also, a plurality of female hooks are formed on the head protection cap portion to be able to recess-projection fit with the plurality of male hooks. The blockish inside pads for the right and left cheeks are attached to the head protection cap portion by recess-projection fitting the plurality of male hooks in the plurality of female hooks.

However, According to the helmet disclosed in EP 0 879 566 A2, prior to removal of the helmet from the head of the helmet wearer having a traffic accident, e.g., a motor cycle accident, a person who takes care of the helmet wearer must (a) disengage the plurality of male hooks from the plurality of female hooks directly by hand or by operating an operating member by hand, and (b) at least partially pull out the blockish inside pad for the right and/or left cheek from the head protection cap portion by pulling the pull member.

Since the helmet must be removed from the head of the helmet wearer after performing these two types of preliminary operations described in (a) and (b), the preliminary operations for removing the helmet become cumbersome, and cannot be performed quickly.

SUMMARY OF THE INVENTION

The present invention has been made to overcome the above-described drawbacks of a helmet disclosed in EP 0 879 566 A2. It is an object of the present invention to provide a helmet and a method of removing the same capable of easily and quickly removing the helmet worn by a helmet wearer on his/her head, including a preliminary operation.

According to the first aspect of the present invention, a helmet comprises a head protecting cap portion with one or a plurality of blockish inside pads disposed therein, at least one blockish inside pad being attached to the head protecting cap portion by one or a plurality of recess-projection fitting mechanisms, and at least one recess-projection fitting mechanism comprising a male hook disposed on the at least one blockish inside pad, and a female hook disposed on the head protecting cap portion to be able to recess-projection fit with the male hook, and pulling means for extracting the at least one blockish inside pad from inside the head protecting cap portion at least partly, the pulling means being pulled to extract the at least one blockish inside pad from inside the head protecting cap portion at least partly, characterized in that the helmet further comprises a pad takeout member including an interrupt portion capable of interrupting between the male hook and the female hook, which recess-projection fits with the make hook, and the pulling means, and when pulling the pulling means, the interrupt portion interrupts between the male hook and the female hook to disengage recess-projection fitting thereof, and is caught on the male hook, and the male hook is pulled out to outside the head protecting cap portion at least halfway to take out the at least one blockish inside pad from inside the head protecting cap portion at least partly.

According to the first aspect of the present invention, the at least one blockish inside pad can be at least partially taken out from the interior of the head protection cap portion by pulling the pulling means of the pad takeout means even if the helmet is difficult to remove from the head of the helmet wearer. Accordingly, the head protection cap portion can be taken out from the head with a relatively small force, and a helmet removing operation can be easily and quickly performed, including the preliminary operation.

According to the first aspect of the present invention, in the first mode, the at least one blockish inside pad preferably comprises a blockish inside pad for a left cheek and/or a blockish inside pad for a right cheek. According to the first aspect of the present invention, in the second mode, the pad takeout member preferably comprises a takeout member main body including the interrupt portion and a pull member attaching to the takeout member main body. In this case, the pull member may comprise a substantially loop-shaped tape-like fabric cord. According to the first aspect of the present invention, in the first and second modes, the blockish inside pad can be at least partially taken out from the interior of the head protection cap portion more easily.

According to the first aspect of the present invention, in the third mode, the plurality of recess-projection fitting mechanisms may attach the at least one blockish inside pad to the head protecting cap portion, and when pulling the pulling means, recess-projection fitting of at least another recess-projection fitting mechanism excluding one of the plurality of recess-projection fitting mechanisms may be disengaged. In this case, the recess-projection fitting mechanism can comprise three recess-projection fitting mechanisms, and when pulling the pulling means, two interrupt portions can disengage recess-projection fitting of two of the recess-projection fitting mechanisms, and the blockish inside pad can pivot forward about remaining one of the recess-projection fitting mechanisms as a fulcrum toward outside the head protecting cap portion. According to the first aspect of the present invention, in the third mode, recess-projection fitting of all the plurality of recess-projection fitting mechanisms need not be disengaged by pulling the pulling means of the pad takeout member. Hence, the pad takeout member can have a simple structure, and be reliably operated when pulling the pulling means of the pad takeout member.

According to the first aspect of the present invention, in the fourth mode, the pad takeout member preferably comprises an engaging hole in which the male hook is to be inserted, the male hook inserted in the engaging hole of the pad takeout member is fitted with the female hook by recess-projection fitting, and the interrupt portion is provided around the engaging hole at least partly. In this case, the engaging hole may comprise an end lug hole. Also, the interrupt portion may comprise a thick portion which is arcuated or the like, or another one. According to the first aspect of the present invention, in the fourth mode, since the pad takeout member can be reliably engaged with the male hook, the pad takeout member can be more reliably operated when pulling the pulling means of the pad takeout member.

According to the first aspect of the present invention, in the fifth mode, the blockish inside pad can comprise at least one thick plate-like cushion member and a bag-like member which covers the cushion member like a bag, the bag-like member comprising a bag main body including an opening, through which the cushion member can be loaded and unloaded, in one surface thereof, and a plurality of holding members each of which is formed of a thin plate-like elastic material and covers the opening at least partly, part of an outer portion of each of the plurality of holding members attaching to the bag main body on part of a peripheral portion of the opening, and at least one engaging mechanism detachably engages the plurality of holding members with each other, the at least one engaging mechanism comprising the male hook provided to at least one of the plurality of holding members, and a second engaging hole formed in at least another one of the plurality of holding members to detachably engage with the male hook. In this case, the second engaging hole may comprise, e.g., three notched holes. According to the first aspect of the present invention, in the fifth mode, the blockish inside pad has a simple structure and relatively high strength, and a cushion member can easily be taken out of and put in-a bag-like member of the blockish inside pad. Accordingly, a cushion member with substantially the same or different shape as that of the cushion member taken out of the bag-like member replaces it and is put in the bag-like member, so the old cushion member can be easily replaced with a new one or the size and shape of the internal space of the head protection cap portion can be easily changed. In addition, the blockish inside pad can be attached to the head protection cap portion reliably and correctly with a simplified attaching structure.

According to the second aspect of the present invention, a removing method of removing, from a head of a helmet wearer, a helmet comprising a head protecting cap portion with one or a plurality of blockish inside pads disposed therein includes attaching at least one blockish inside pad to the head protecting cap portion in advance by one or a plurality of recess-projection fitting mechanisms, when attaching the at least one blockish inside pad, using, as at least one recess-projection fitting mechanism, a mechanism comprising a male hook disposed on the at least one blockish inside pad, and a female hook disposed on the head protecting cap portion to be able to recess-projection fit with the male hook, providing in advance the helmet with pulling means for extracting the at least one blockish inside pad from inside the head protecting cap portion at least partly, when removing the helmet worn on the head of the helmet wearer, first, pulling the pulling means to extract the at least one blockish inside pad from inside the head protecting cap portion at least partly, and subsequently removing the head protecting cap portion from the head of the helmet wearer, the method characterized by comprising mounting in advance, on the head protecting cap portion, a pad takeout member including the pulling means and an interrupt portion capable of interrupting between the male hook and the female hook, which recess-projection fits with the male hook, when removing the helmet worn on the head of the helmet wearer, pulling the pulling means first to cause the interrupt portion to interrupt between the male hook and the female hook to disengage recess-projection fitting thereof, and catching the interrupt portion on the male hook, and pulling out the male hook to outside the head protecting cap portion at least halfway to take out the at least one blockish inside pad from inside the head protecting cap portion at least partly, and subsequently, removing the head protecting cap portion from the head of the helmet wearer.

Note that according to the second aspect of the present invention, the helmet according to the first aspect of the present invention in the various modes (including the first to fifth modes) can be used. According to the second aspect of the present invention, substantially the same effect as that in the first aspect of the present invention can be obtained.

The above, and other, objects, features and advantages of this invention will become readily apparent from the following detailed description thereof which is to be read in connection with the accompanying drawings.

BRIEF DESCRIPTION OF THE DRAWINGS

FIG. 11 is a perspective view of the helmet in. FIG. 1 in a worn state, in the process of pulling out the blockish inside pads for the cheeks from the impact-on-the-chin-and-cheek absorbing liners.

DETAILED DESCRIPTION OF THE INVENTION

An embodiment in which the present invention is applied to a full-face-type helmet will be described first with reference to drawings in "1. Schematic Composition of Helmet as a Whole", "2. Composition of Blockish Inside Pad for Cheek", "3. Composition of Pad Takeout Member" and "4. Helmet Removing Operation".

1. Schematic Composition of Helmet as a Whole

Figure 1:
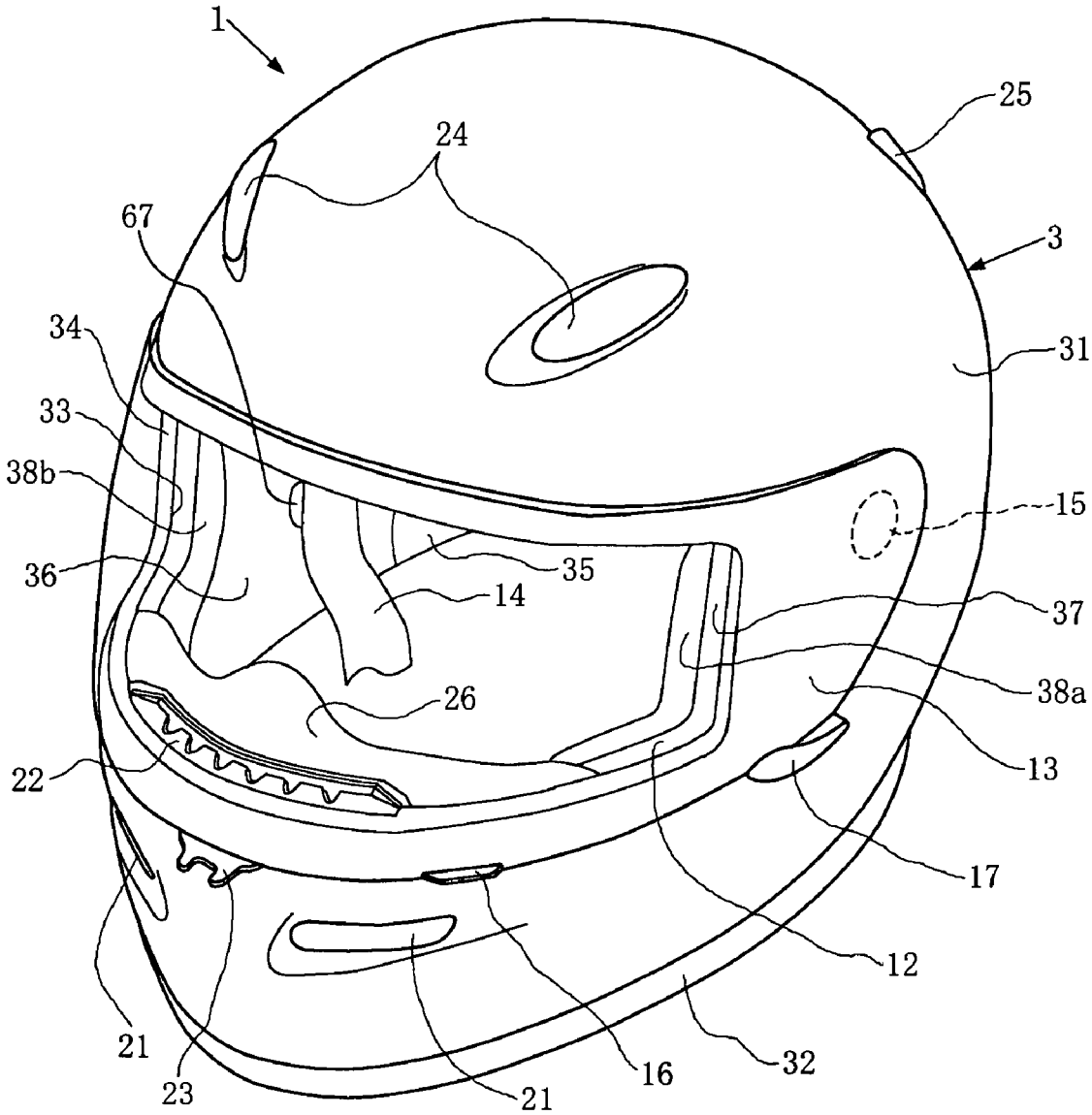
FIG. 1 is an overall perspective view of a helmet in an embodiment in which the present invention is applied to a full-face-type helmet.
Figure 11:
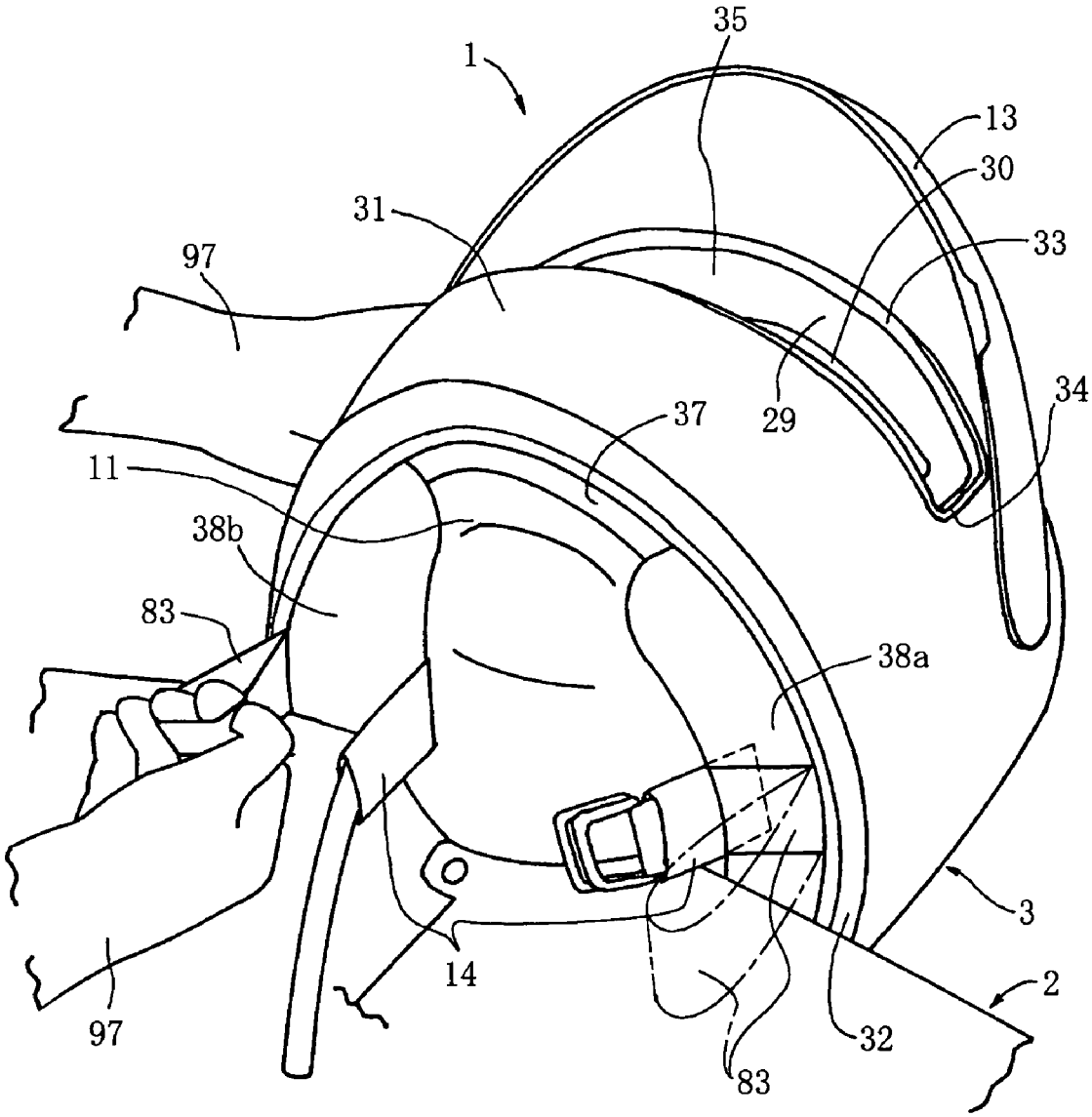
Figure 12:
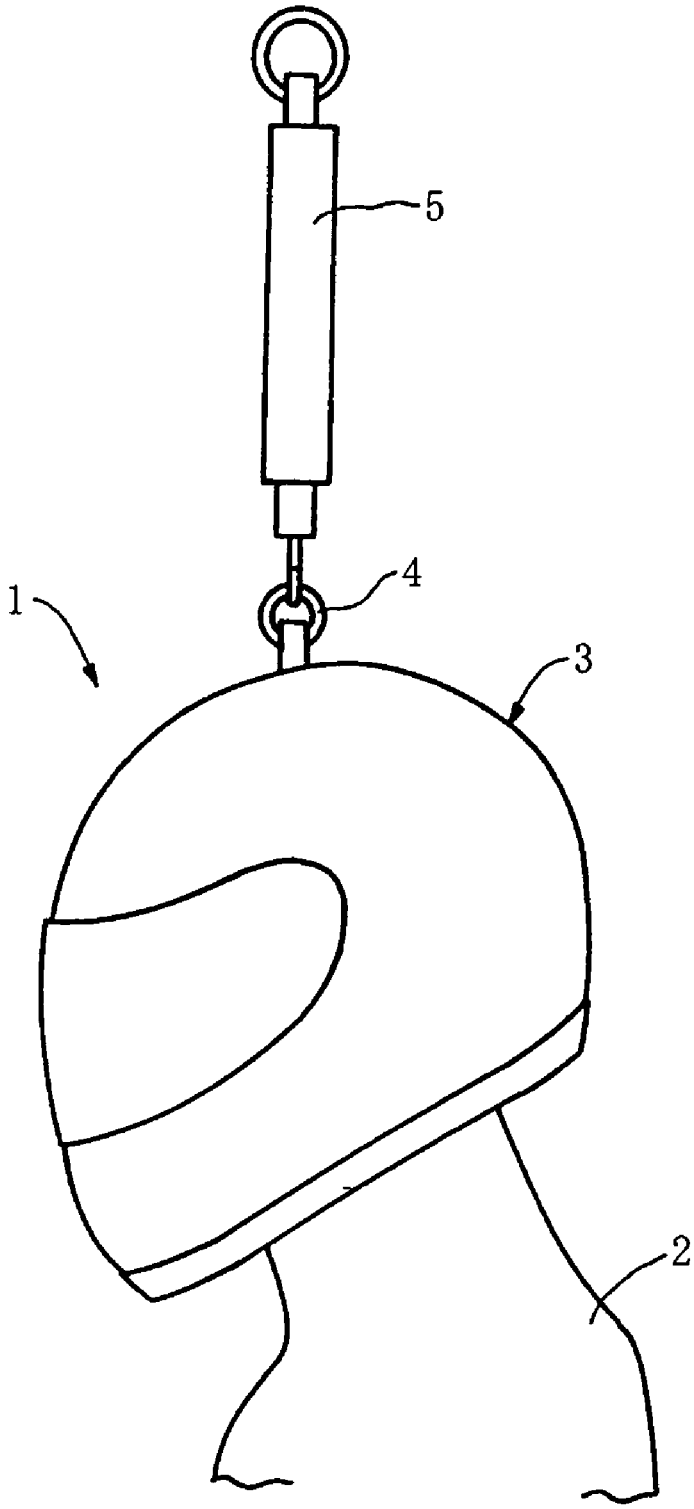
FIG. 12 PRIOR ART
FIG. 12 is a right side view showing an experiment aimed at measuring the force required to remove a conventional full-face-type helmet from the head of a wearer.

As shown in FIGS. 1 and 11, a full-face-type helmet 1 is made up of a full-face-type head protecting cap portion 3, a shield 13 and a pair of right and left chin straps 14. Note that the head protecting cap portion 3 is to be worn on a head 11 of a helmet wearer 2, e.g., the rider of a motor cycle. The shield 13 is capable of opening/closing a window opening 12 formed in the front surface of the head protecting cap portion 3 to oppose the portion (i.e., the center portion of the face) between the forehead and chin of the helmet wearer 2. The chin straps 14 are attached to the interior of the head protecting cap portion 3. As has been known, the shield 13 may be made of a transparent or translucent, hard material such as polycarbonate or another type of hard synthetic resin. The right and left end portions of the shield 13 is pivotally mounted on the head protecting cap portion 3 with a pair of right and left mounting screws 15. The shield 13 closes the window opening 12 at the backward pivoting position shown in FIG. 1, and opens the window opening 12 at the forward pivoting position at which the shield 13 pivots upward from the backward pivoting position. At the intermediate position between these positions, the shield 13 can partly opens the window opening 12. In FIG. 1, a tap 16 is formed on the shield 13 to be held by the helmet wearer 2 with his/her fingers when the helmet wearer 2 is to pivot upward and downward the shield 13 forward and backward. An operating lever 17 is formed on the head protection cap portion 3 to be held by the helmet wearer 2 with his/her fingers and operated when the helmet wearer 2 is to slightly pivot upward the shield 13 located at the backward pivoting position.

As is conventionally known, if necessary, the head protection cap portion 3 shown in FIGS. 1 and 11 may incorporate one or a plurality of types of ventilator mechanisms. In FIG. 1, a pair of right and left air supply ports serving also as exhaust ports 21 are formed in the chin region of the head protection cap portion 3 opposing the chin of the helmet wearer 2. An outlet port forming member 22 forms an outlet port through which air introduced from the air supply ports 21 flows upward along the inner surface of the shield 13. An operating tap 23 operates a shutter that opens/closes the outlet port formed by the outlet port forming member 22. A pair of right and left air supply port opening/closing shutters 24 are formed in the front region of the head protection cap portion 3 opposing the front of the head of the helmet wearer 2. A pair of right and left exhaust port opening/closing shutters 25 are formed in the back region of the head protection cap portion 3 opposing the back of the head of the helmet wearer 2. A breath guard 26 is formed near the chin region of the head protection cap portion 3 to be adjacent to the outlet port forming member 22.

As shown in FIGS. 1 and 11, the head protecting cap portion 3 is made up of a full-face-type outer cap shell 31, a lower rim member 32 having a substantially U-shaped cross-section, a rim member 34 for the window opening, which has a substantially E-shaped cross-section, a backing member 35 for the head, and a backing member 36 for the chin and cheeks. Note that the outer cap shell 31 forms the circumferential wall of the head protecting cap portion 3. The lower rim member 32 is fixed to the outer shell 31 throughout the lower end portion of the outer shell 31 with an adhesive or the like. In addition, the rim member 34 is fixed to the outer shell 31 throughout the circumference of a window opening 33 with an adhesive or the like in order to form the window opening 12 of the head protecting cap portion 3. The backing member 35 is fixed to the outer shell 31 with an adhesive or the like in contact with the inner surface of the outer shell 31 in a front head region, a top head region, right and left side head regions, and a back head region respectively corresponding to the front part, top part, right and left parts, and back part of the head of the helmet wearer 2. The backing member 36 is fixed to the outer shell 31 with an adhesive or the like in contact with the inner surface of the outer shell 31 in chin and cheek regions respectively corresponding to the chin and cheeks of the helmet wearer 2. The outer shell 31 can be made of a composite material. More specifically, the outer shell 31 can be formed by lining the inner surface of a strong shell body made of a hard synthetic resin, e.g., FRP, with a flexible sheet such as a porous unwoven fabric. The lower rim member 32 can be made of a soft synthetic resin such as expanded vinyl chloride or synthetic rubber. The rim member 34 can be made of an elastic material with high flexibility such as synthetic rubber.

As shown in FIGS. 1 and 11, the backing member 35 for the head is constituted by an impact-on-the-head absorbing liner 29 and a permeable backing cover 30 for the head. Note that the backing cover 30 is attached to the impact-on-the-head absorbing liner 29 so as to cover substantially the entire inner surface of the impact-on-the-head absorbing liner 29. As shown in FIGS. 1 and 11, the backing member 36 for the chin and cheeks is constituted by an impact-on-the-chin-and-cheek absorbing linear 37 and a pair of blockish inside pads 38*b* and 38*a* for the right and left cheeks. The inside pads 38*b* and 38*a* are attached to the impact-on-the-chin-and-cheek absorbing liner 37 in contact with the inner surface of the impact-on-the-chin-and-cheek absorbing liner 37 in right and left cheek regions respectively corresponding to the right and left cheeks of the helmet wearer 2.

Each of the body portions of the impact-on-the-head absorbing liner 29 and the impact-on-the-chin-and-cheek absorbing liner 37 shown in FIGS. 1 and 11 can be made of a material with appropriate rigidity and appropriate plasticity such as expanded polystyrene or another synthetic resin. The body portion of the backing cover 30 for the head can be made by combining a woven fabric and a porous unwoven fabric obtained by laminating a layer with an appropriate shape which consists of an elastic material with high flexibility such as urethane or another synthetic resin, on the surface (i.e., the outer surface) opposing the impact-on-the-head absorbing liner 29, or on the both surfaces.

2. Composition of Blockish Inside Pad for Cheek

The pair of right and left blockish inside pads 38*a* and 38*b* for the cheeks are symmetrical to each other. Hence, the blockish inside pad 38*b* for the right cheek will be described in detail with reference to FIGS. 2, 3, 6, 9 and 10, and a detailed description on the blockish inside pad 38*a* for the left cheek will be omitted according to circumstances.

Figure 2:
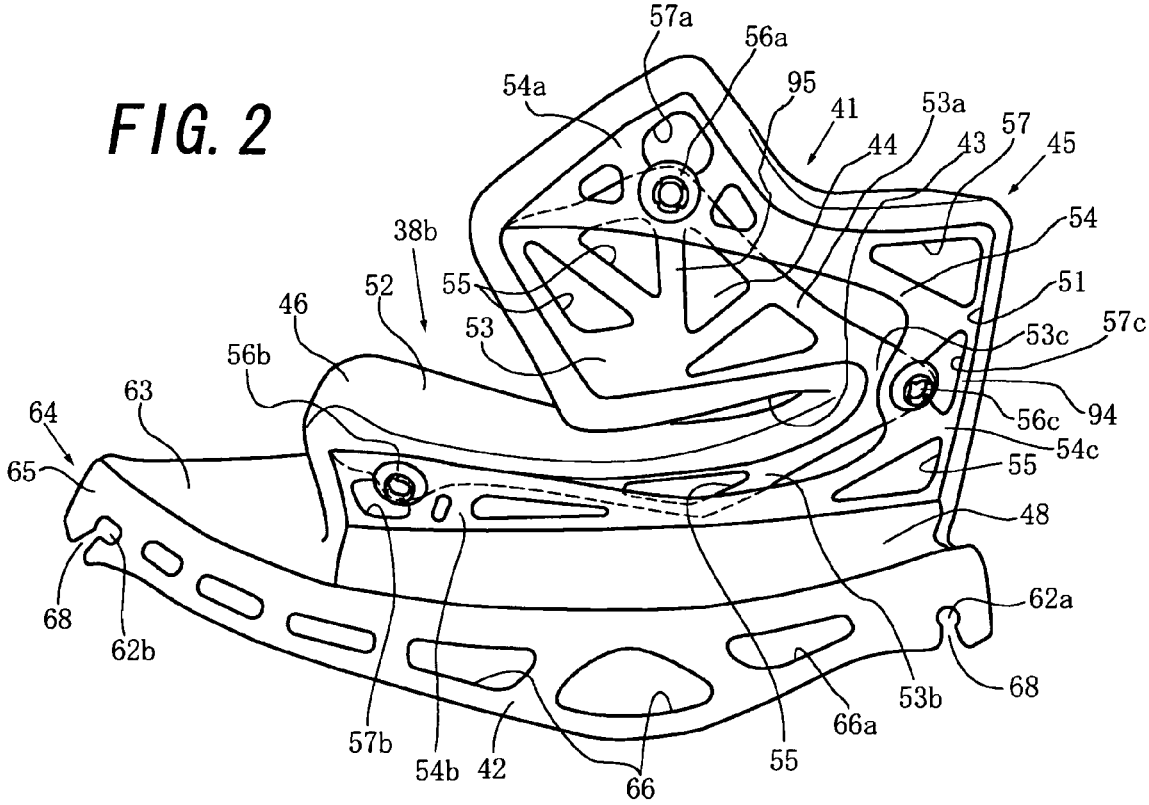
FIG. 2 is a rear view showing a state wherein an engaging member of a blockish inside pad for a right cheek shown in FIG. 1 is expanded downward.
Figure 3:
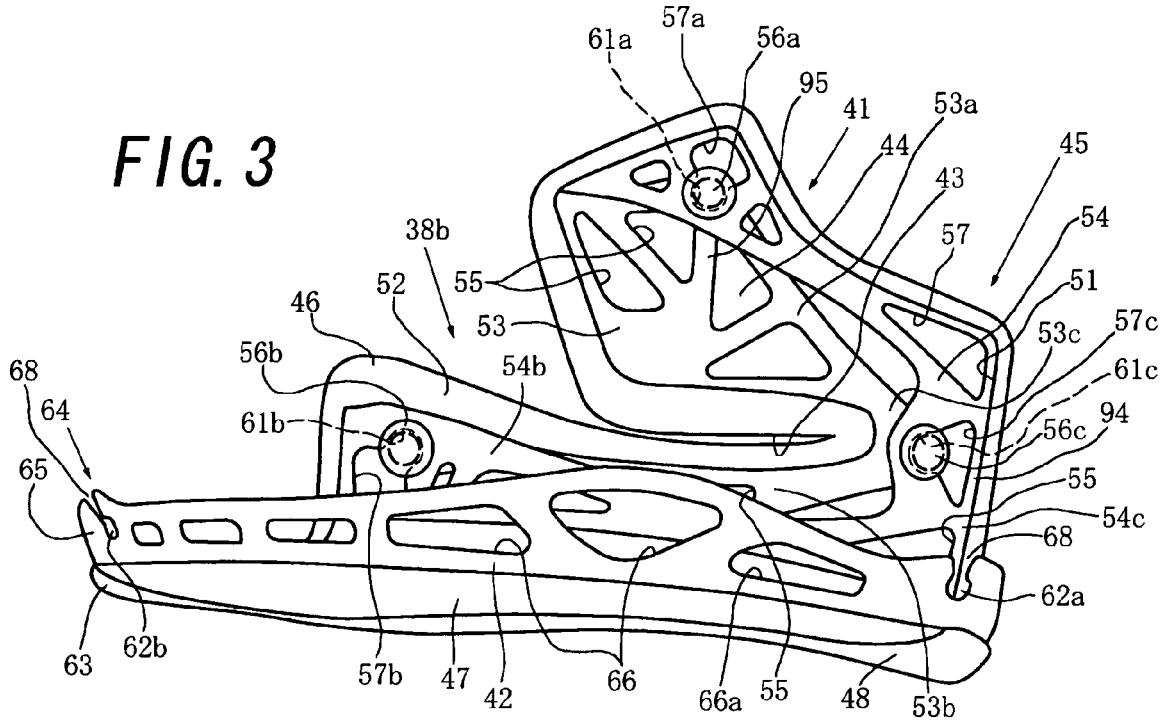
FIG. 3 is a rear view showing a state wherein the blockish inside pad alone for the right cheek shown in FIG. 1 is attached to an impact-on-the-chin-and-cheek absorbing linear.
Figure 6:
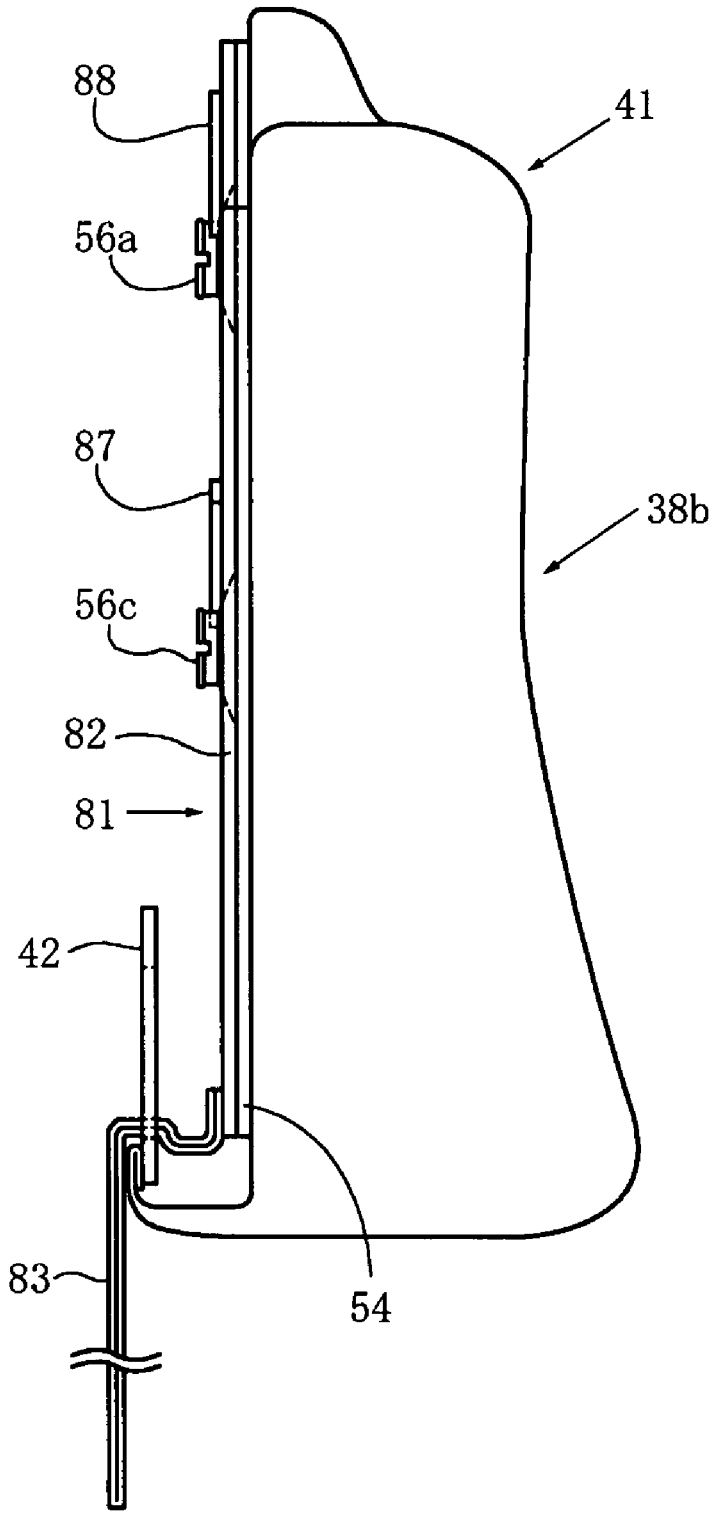
FIG. 6 is a right side view of the blockish inside pad for the right cheek shown in FIG. 5.

As shown in FIGS. 2, 3 and 6, the blockish inside pad 38*b* for the right cheek comprises a pad main body 41 and an elongated locking member 42 which attaches near the lower end of the pad main body 41 throughout substantially its entire length with a sewing thread, a tape, an adhesive or the like. The pad main body 41 has a notch 43 to exclude an ear region corresponding to the right ear of the helmet wearer 2. Accordingly, the pad main body 41 has a shape corresponding to the right cheek and its vicinity (excluding the right ear) of the helmet wearer 2. The pad main body 41 comprises a thick plate-like cushion member 44 which is formed of one or a plurality of highly flexible elastic members such as urethane foam or another synthetic resin, and a bag-like member 45 which covers the cushion member 44 substantially entirely like a bag. Hence, the cushion member 44 is accommodated in and attaches to the bag-like member 45.

As shown in FIGS. 2 and 3, that surface (i.e., the front surface and, in other words, an inner surface which abuts against the right cheek of the helmet wearer 2) of the bag-like member 45 which is opposite to the surface (i.e., the rear surface) opposing the impact-on-the-chin-and-cheek absorbing liner 37 is substantially entirely formed of a woven fabric portion 46. That one half of the lower surface of the bag-like member 45 which is on the locking member 42 side is substantially entirely formed of a synthetic leather portion 47 such as vinyl leather. The lower portion of that surface of the bag-like member 45 which opposes the impact-on-the-chin-and-cheek absorbing liner 37 is formed of a porous nonwoven fabric portion 48. The woven fabric portion 46, synthetic leather portion 47 and porous nonwoven fabric portion 48 constitute a bag main body 52 of the bag-like member 45 having an opening 51 which is formed as the upper portion and central portion of that surface of the bag-like member 45 which opposes the impact-on-the-chin-and-cheek absorbing liner 37 continue. The materials of the portions 46, 47, and 48 are not limited to woven fabric, porous or nonporous nonwoven fabric, and synthetic leather, respectively, but can be formed of an arbitrary flexible sheet material including the above materials, a synthetic resin sheet, paper, synthetic resin-laminated paper, and/or natural leather.

A pair of inner and outer holding members 53 and 54, which are formed of thin plate-like elastic materials and vertically laid on each other, partly cover the opening 51 of the bag main body 52 of the bag-like member 45 shown in FIGS. 2 and 3. As shown in FIGS. 2 and 3, each of the inner and outer holding members 53 and 54 may be formed by connecting a large number of substantially band-like portions integrally to form a thin plate-like shape as a whole. Accordingly, each of the inner and outer holding members 53 and 54 may be obtained by punching a sheet material made of a less flexible elastic material, e.g., a soft synthetic resin such as polypropylene or polyethylene, or paper laminated with such a soft synthetic resin, into an appropriate shape. From the viewpoint of practice, generally, the thickness of the sheet material and accordingly of each of the inner and outer holding members 53 and 54 preferably falls within a range of 0.2 mm to 2.5 mm and more preferably within a range of 0.4 mm to 1.8 mm.

As shown in FIGS. 2 and 3, the inner holding member 53 comprises an upper side portion 53*a*, a lower side portion 53*b* and a connecting portion 53*c* which connects the upper and lower side portions 53*a* and 53*b* integrally on the front end side, to form a substantially yoked shape. At the corresponding portions (i.e., part of the outer portion of the inner holding member 53) of the upper side portion 53*a*, the lower side portion 53*b* and the connecting portion 53*c* which are along the notch 43, the inner holding member 53 attaches to part of the outer portion of the opening 51 of the bag main body 52 with a sewing thread, a tape, an adhesive or the like. Each of the upper side portion 53*a*, lower side portion 53*b* and connecting portion 53*c* of the inner holding member 53 has one or a plurality of openings 55. Male portions (i.e., male hooks) 56*a*, 56*b* and 56*c* of round hooks serving as locking projections or fitting projections attach to portions in the vicinities of the rear ends of the upper and lower side portions 53*a* and 53*b*, and the connecting portion 53*c* by fixing with rivets (see FIG. 10) or the like.

As shown in FIGS. 2 and 3, the outer holding member 54 comprises an upper side portion 54*a*, a lower side portion 54*b* and a connecting portion 54*c* which connects the upper and lower side portions 54*a* and 54*b* integrally on the front end side, to form a substantially yoked shape. At the corresponding portions (i.e., part of the outer portion of the outer holding member 54) of the upper side portion 54*a*, the lower side portion 54*b* and the connecting portion 54*c* which are other than the lower end of the upper side portion 54*a*, the upper end of the lower side portion 54*b* and the rear end of the connecting portions 54*c*, the outer holding member 54 attaches to the outer portion of the opening 51 of the bag main body 52 with a sewing thread, a tape, an adhesive or the like. Each of the upper side portion 54*a*, lower side portion 54*b* and connecting portion 54*c* of the outer holding member 54 has a plurality of openings 57. The upper side portion 54*a* has, around an opening 57*a* in the vicinity of its rear end, a notched engaging hole 61*a* corresponding to the upper male hook 56*a* to continue to the opening 57*a*. The lower side portion 54*b* has, around an opening 57*b* in the vicinity of its rear end, a notched engaging hole 61*b* corresponding to the lower male hook 56*b* to continue to the opening 57*b*. The connecting portion 54*c* has, around an opening 57*c*, a notched engaging hole 61*c* corresponding to the front male hook 56*c* to continue to the opening 57*c*.

As shown in FIGS. 2, 3 and 6, bases 59 of annular male portions 60 (see FIG. 10) of the male hooks 56*a*, 56*b* and 56*c* respectively, detachably fix in the engaging holes 61*a*, 61*b* and 61*c* by fitting. This couples the inner holding member 53 and outer holding member 54 to each other by detachable recess-projection engagement of the engaging projections comprising the annular male portions 60 of the male hooks 56*a*, 56*b* and 56*c* with the engaging holes 61*a*, 61*b* and 61*c*. When fixing the male hooks 56*a*, 56*b* and 56*c* in the engaging holes 61*a*, 61*b* and 61*c* by fitting, after inserting the male hooks 56*a* to 56*c* in the openings 57*a* to 57*c*, the inner holding member 53 is moved relative to the engaging holes 61*a* to 61*c* respectively in substantially a planar direction. This can press-fit the bases (i.e., narrow portions) 59 of the annular male portions of the male hooks 56*a* to 56*c* respectively in the engaging holes 61*a* to 61*c* very easily to engage and fix them.

As shown in FIGS. 2 and 3, the locking member 42 has a pair of front and rear notches 62*a* and 62*b* in the vicinities of its front and rear ends. When the blockish inside pad 38*b* for the right cheek attaches to the impact-on-the-chin-and-cheek absorbing liner 37 (i.e., the state shown in FIG. 3), the pair of notches 62*a* and 62*b* extend upward or obliquely upward to respectively continue to portions around the locking member 42 through narrow portions 68 respectively formed at the inlets of the pair of notches 62*a* and 62*b*. The rear end of the locking member 42, together with the bag main body 52, projects more backward than the cushion member 44 of the pad main body 41 to form a backward projection 65 to constitute an inserting portion 64 together with a backward projection 63 of the bag main body 52. The locking member 42 has a plurality of openings 66 in its longitudinal direction to impart flexibility and reduce the weight. The locking member 42 can be made of a soft synthetic resin or the like such as polyethylene.

Figure 7:
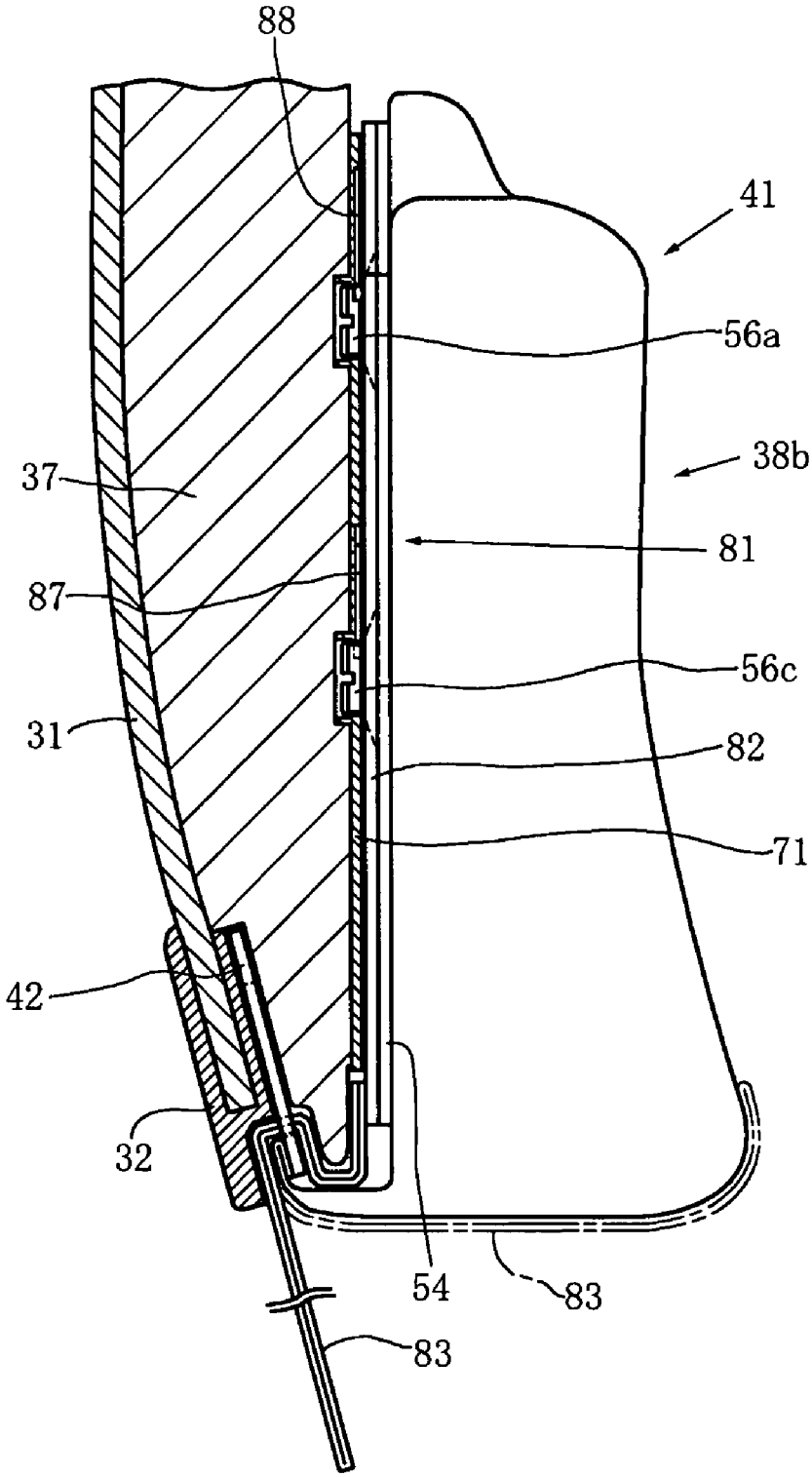
FIG. 7 is a partial sectional view in a state wherein the blockish inside pad for the right cheek shown in FIG. 6 is attached to the impact-on-the-chin-and-cheek absorbing liner.
Figure 9:
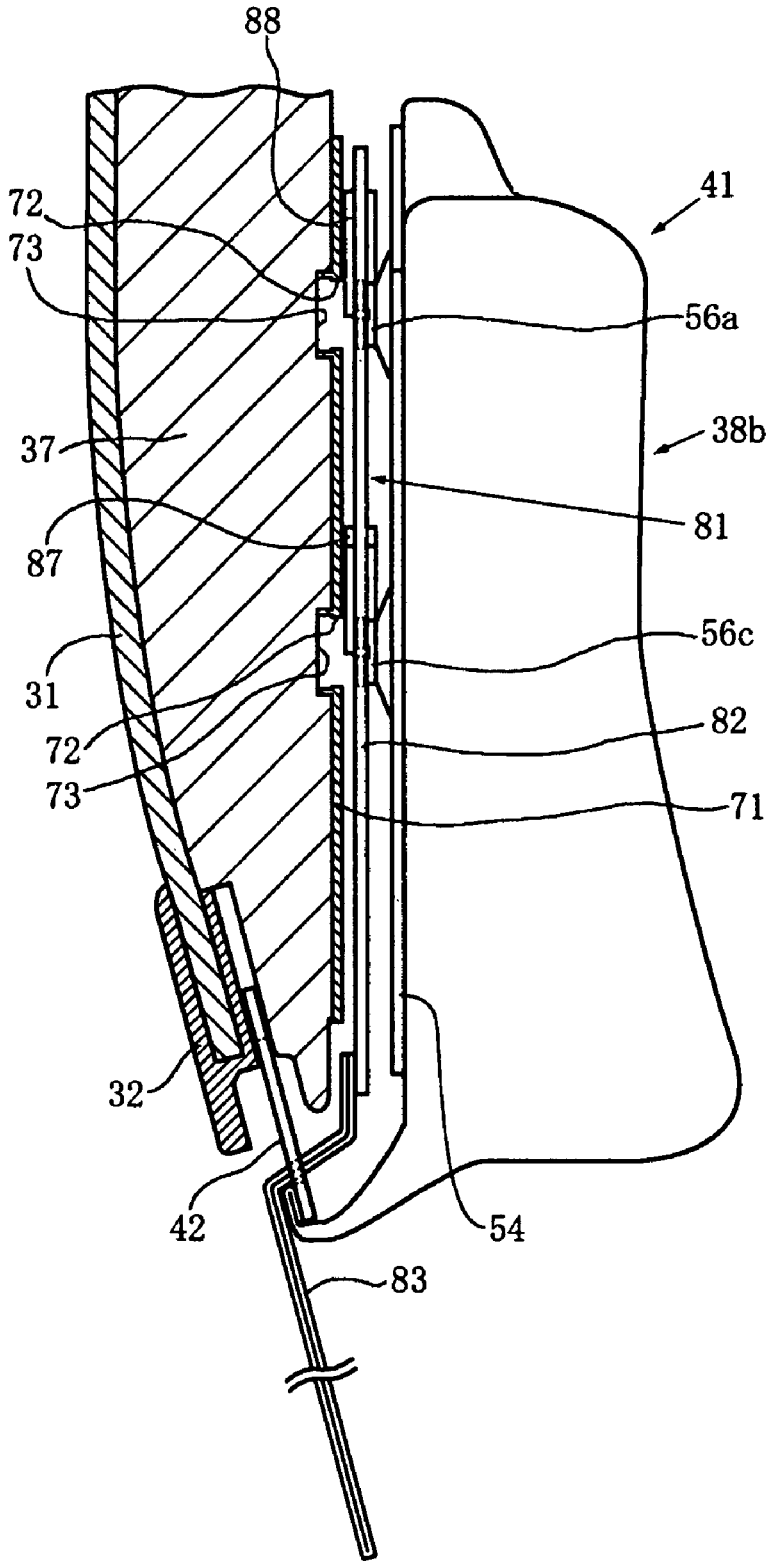
FIG. 9 is a sectional view similar to FIG. 7 and shows the second state in the process of pulling out the blockish inside pad for the right cheek shown in FIG. 7 from the impact-on-the-chin-and-cheek absorbing liner.
Figure 10:
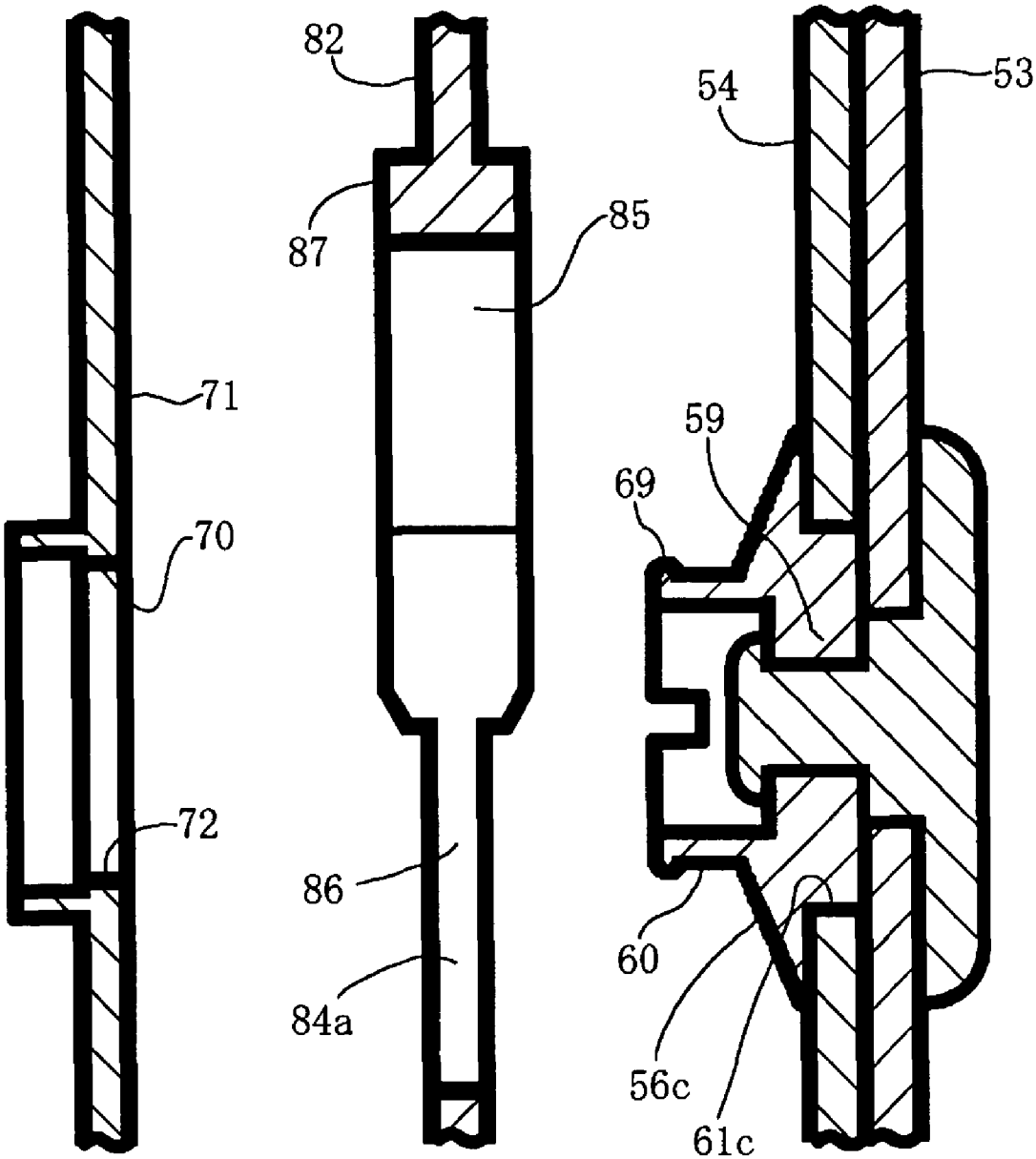
FIG. 10 is an exploded enlarged sectional view of a portion near a front male hook shown in FIG. 9.

As shown in FIG. 7, the blockish inside pad 38*b* for the right cheek attaches to the inner surface of right half of the impact-on-the-chin-and-cheek absorbing liner 37 to be in contact with it. A pair of right and left thin plate-like support members 71 attach to that surface (i.e., the inner surface) of the main body portion of the impact-on-the-chin-and-cheek absorbing liner 37 which is on a side opposite to the outer shell 31 by adhesion or the like. As shown in FIGS. 9 and 10, each support member 71 has female portions (i.e., female hooks) 72 of round hooks, which are formed by, e.g., monolithic molding with the support member 71 or attaching with rivets, to respectively oppose the male hooks 56*a*, 56*b* and 56*c* of the corresponding one of the pair of right and left blockish inside pads 38*a* and 38*b* for the cheeks. The impact-on-the-chin-and-cheek absorbing liner 37 has recesses 73 to respectively correspond to the female hooks 72. A flexible sheet made of porous nonwoven fabric, vinyl leather or the like may partly cover the main body portion of the impact-on-the-chin-and-cheek absorbing liner 37 in advance. This main body portion may have openings 67 (see FIG. 1) through which the chin straps 14 are to be inserted. The support members 71 may have openings or notches (not shown) at the central portions to correspond to the openings 67. The main body portion of the impact-on-the-chin-and-cheek absorbing liner 37 and the main body portion of the impact-on-the-head absorbing liner 29 may be provided with locking pins (not shown) which respectively oppose the notches 62*a* and 62*b* of the locking member 42 and relatively engage with the notches 62*a* and 62*b*.

To attach the blockish inside pad 38*b* for the right cheek shown in FIGS. 2 and 3 to the impact-on-the-chin-and-cheek absorbing liner 37 as shown in FIGS. 1 and 7, the male hooks 56*a*, 56*b* and 56*c* of the blockish inside pad 38*b* may be recess-projection engaged with the female hooks 72 of the impact-on-the-chin-and-cheek absorbing liner 37. In this case, annular projections 69 formed of the distal end portions of the annular male portions 60 of the male hooks 56*a* to 56*c* elastically engage with annular projections 70 formed of the front end portions of the female hooks 72, respectively. The locking member 42 of the blockish inside pad 38*b* is inserted in advance between the outer shell 31, and the blockish inside pad 38*b* for the right cheek and impact-on-the-head absorbing liner 29 from below. At this time, the inserting portion 64 of the blockish inside pad 38*b* is also inserted between the outer shell 31 and impact-on-the-head absorbing liner 29 from below. The engaging pins of the impact absorbing liners 37 and 29 relatively fit in the notches 62*a* and 62*b* of the locking member 42 from above to recess-projection engage with them. The chin strap 14 inserted through the opening 67 of the impact absorbing liner 37 is relatively inserted in the notch 43 of the inside pad 38*b*. When removing the inside pad 38*b* from the impact absorbing liners 37 and 29, operation opposite to that described above for attaching may be performed.

An example of the operation of taking the cushion-member 44 out of the blockish inside pad 38*b* for the right cheek shown in FIGS. 2, 3 and 6 will be described.

Assume that the blockish inside pad 38*b* is alone in the state shown in FIG. 2. First, those portions of the holding member 53 which are in the vicinities of the male hooks 56*a*, 56*b* and 56*c* are moved downward, forward and obliquely downward respectively with respect to the outer holding member 54 to extract the annular male portions 60 of the male hooks 56*a*, 56*b* and 56*c* respectively from the engaging holes 61*a*, 61*b* and 61*c*, and then the inner holding member 53 is brought to above the outer holding member 54. Subsequently, the inner holding member 53 is reversed from the front side to the rear side in FIG. 2 of the cushion member 44 and bag main body 52 with reference to the vicinity of that portion of the pad main body 41 which is around the notch 43 as a reverse line. In the reversal state, the inner holding member 53 is not present on the opening 51, and only the outer holding member 54 is present on the opening 51. Therefore, the cushion member 44 can be taken out of the bag main body 52 very easily while elastically deforming the outer holding member 54 appropriately. When storing the cushion member 44 or another cushion member in the bag main body 52, operation opposite to that described above may be performed.

3. Composition of Pad Takeout Member

As shown in FIGS. 6 and 7, where necessary, one or both of a pair of right and left pad takeout members 81, which are used to take out the pair of right and left blockish inside pads 38*a* and 38*b* for the cheeks from the inside of the head protecting cap portion 3 at least partly, can engage with the pair of right and left blockish inside pads 38*a* and 38*b* for the cheeks. As the pair of right and left pad takeout members 81 are axi-symmetrical to each other, the right pad takeout member 81 will be described in detail with reference to FIGS. 4 and 5, and a detailed description on the left pad takeout member 81 will be omitted according to circumstances.

Figure 4:
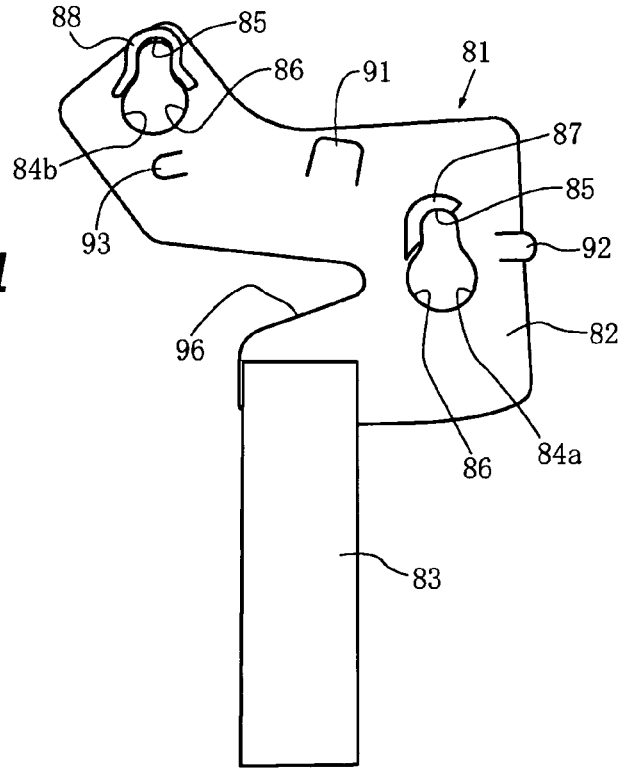
FIG. 4 is a front view showing a state wherein a pad takeout member alone incorporated in the helmet shown in FIG. 1 is attached to the blockish inside pad for the right cheek.
Figure 5:
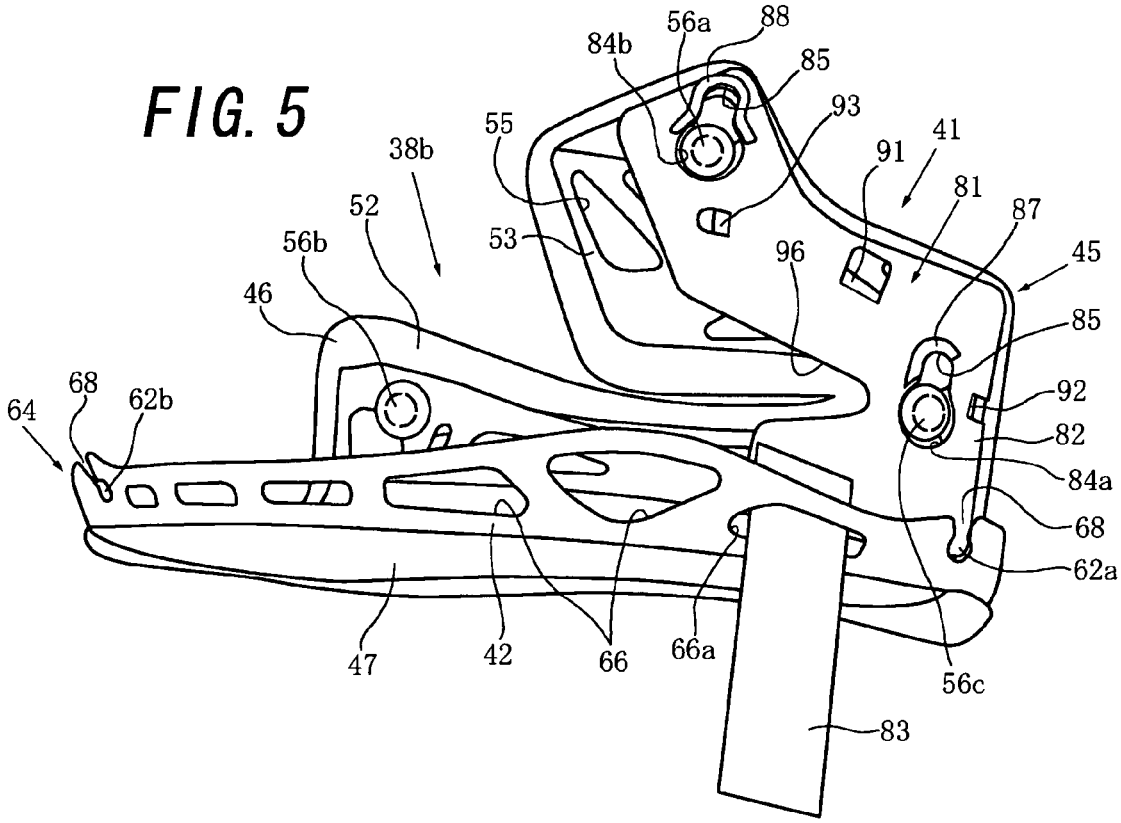
FIG. 5 is a rear view of the blockish inside pad for the right cheek shown in FIG. 3 to which the pad takeout member shown in FIG. 4 is attached.

As shown in FIG. 4, the right pad takeout member 81 comprises a takeout member main body 82 and a pull member 83 which attaches to near the lower end of the takeout member main body 82 by sewing, adhesion or the like. The takeout member main body 82 has a pair of front and rear end lug holes 84*a* and 84*b* to correspond to the male hooks 56*c* and 56*a*, respectively, of the blockish inside pad 38*b* for the right cheek. Each of the pair of front and rear end lug holes 84*a* and 84*b* comprises a small-diameter upper hole 85 and large-diameter lower hole 86 that continue to each other. The two, front and lower sides of the entire portion (excluding the front portion) substantially around the upper hole 85 of the end lug hole 84*a* are formed thick to provide an arcuate thick portion 87. The two, front and rear sides of almost the entire portion (including a portion in the vicinity of the upper end of the lower hole 86) around the upper hole 85 of the rear end lug hole 84*b* are formed thick to constitute an arcuate thick portion 88. As shown in FIGS. 4 and 5, the takeout member main body 82 of the pad takeout member 81 has tongue pieces 91, 92 and 93 each of which is formed by partly punching the takeout member main body 82.

When attaching the takeout member main body 82 to the inside pad 38*b*, first, the male hooks 56*a* and 56*c* of the blockish inside pad 38*b* shown in FIG. 3 which is alone are inserted in the large-diameter lower holes 85 of the potbelly holes 84*b* and 84*a*, respectively, of the takeout member main body 82, to constitute the inside pad 38*b* with the pad takeout member 81, as shown in FIGS. 5 and 6. In this case, as shown in FIG. 5, the pull member 83 is relatively inserted through a front opening 66*a* downward from above. The outer peripheral portion on the lower side of the upper side portion 54*a* of the outer holding member 54 is relatively inserted between the tongue piece 91 of the pad takeout member 81 and the takeout member main body 82, as shown in FIG. 5. A band-like portion 94 extending between the outer peripheral portion on the front side of the connecting portion 54*c* and the opening 57*c* is relatively inserted between the tongue piece 92 of the pad takeout member 81 and the takeout member main body 82. A band-like portion 95 extending between the pair of openings 55 of the upper side portion 53*a* is relatively inserted between the tongue piece 93 of the pad takeout member 81 and the takeout member main body 82. Hence, when slightly pulling the takeout member main body 82 shown in FIG. 5 substantially downward, the tongue pieces 92 and 93 are guided by the band-like portions 94 and 95 to move substantially downward in the same manner. In this movement state, the tongue pieces 92 and 93 can also move substantially upward. Subsequently, as shown in FIG. 7, the male hooks 56*a*, 56*b* and 56*c* of the blockish inside pad 38*b* are fitted in the female hooks 72 of the impact-on-the-chin-and-cheek absorbing liner 37, respectively.

The takeout member main body 82 of the pad takeout member 81 shown in FIGS. 4 and 5 has, at the intermediate portion in the vertical direction, a notch 96 which is notched substantially in a V shape from substantially the rear portion toward substantially the front portion to substantially correspond to the notch 43 of the blockish inside pad 38*b*. In the embodiment shown in FIGS. 4 to 6, the pull member 83 in the form of a comparatively thin tape-like fabric cord is folded into two, and its two ends are attached to near the rear portion of the lower end of the takeout member main body 82. The two ends of the fabric cord 83 may commonly attach to either one surface of the takeout member main body 82, or may attach to the two surfaces of the takeout member main body 82, respectively.

4. Helmet Removing Operation

In the state shown in FIG. 11 in which the helmet wearer 2 wears the full-face-type helmet 1 shown in FIGS. 1 to 10, a person (e.g., a person who takes care of the rider having a motor cycle accident) other than the helmet wearer 2 can remove the helmet 1 from the head 11 of the helmet wearer 2 in the following steps (1) to (8). The helmet wearer 2 himself can also remove the helmet 1 in accordance with the same steps.

(1) First, the person disengages the pair of right and left chin straps 14 from each other, as shown in FIG. 11.

(2) Assume that one or both of the pair of right and left pull members 83 extend along the lower end faces of the pad main bodies 41 of the inside pads 38*a* and 38*b* down to the inner surfaces of the pad main bodies 41, and their distal ends are sandwiched between the pad main bodies 41 and the helmet wearer 2 (see the right pull member 83 in FIG. 11 and the pull member 83 indicated by an alternate long and short dashed line in FIG. 7). In this case, the person holds the pull members 83 with the fingers of his hands 97 and pulls them outwardly as indicated with the left pull member 83 in FIG. 11.

Figure 8:
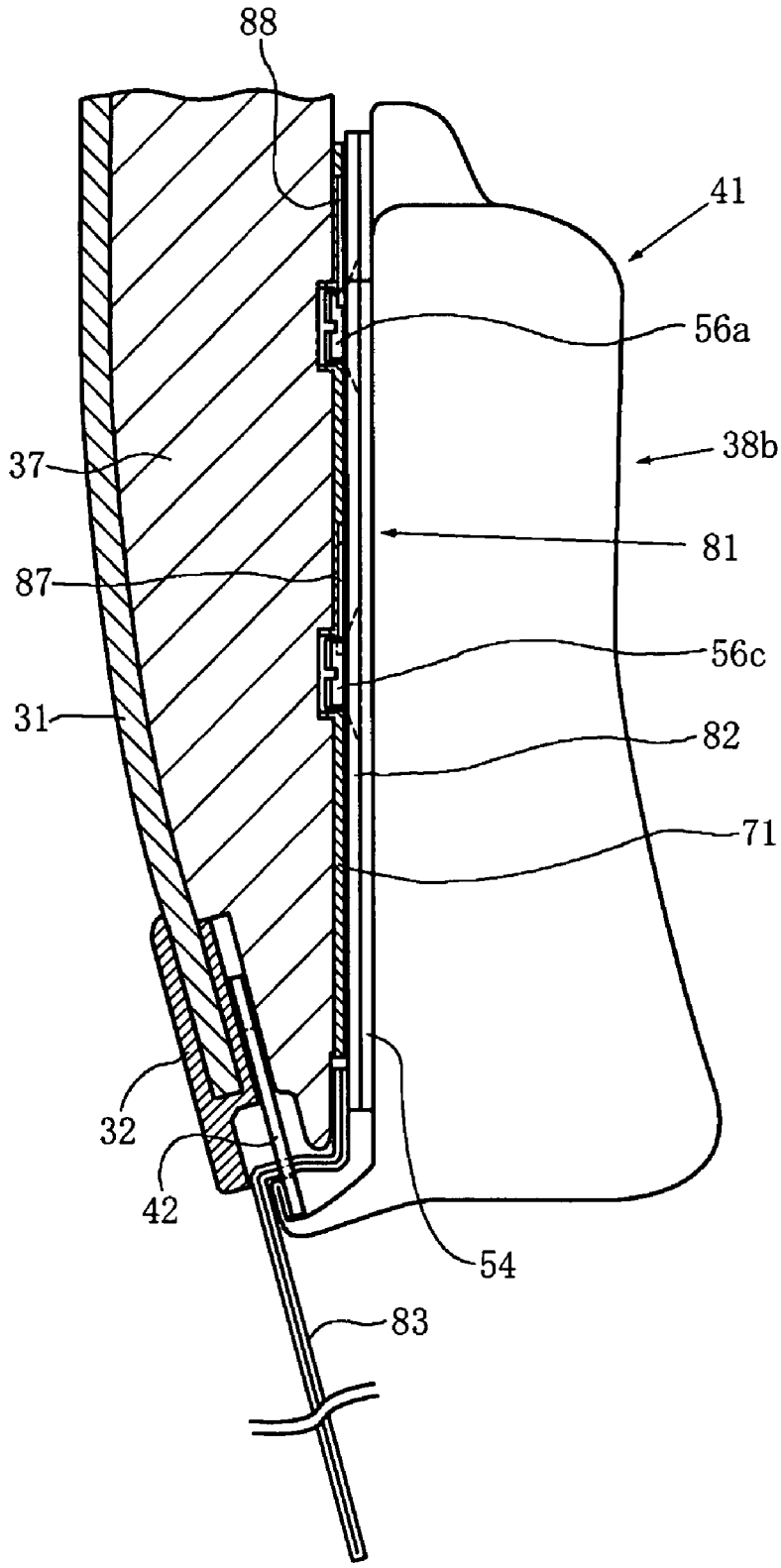
FIG. 8 is a sectional view similar to FIG. 7 and shows the first state in the process of pulling out the blockish inside pad for the right cheek from the impact-on-the-chin-and-cheek absorbing liner.

(3) The person then pulls the outwardly exposed pull members 83 substantially downward from the full-face-type helmet 1 (i.e., toward the front side in FIG. 11) with his hands 97. This extracts the locking members 42 of the inside pads 38*a* and 38*b* to substantially under the helmet 1 halfway from between the outer shell 31 (more particularly, the lower rim member 32), and the impact-on-the-chin-and-cheek absorbing liner 37 and impact-on-the-head absorbing liner 29, as shown in FIG. 8. Accordingly, the locking pins (not shown) respectively engaging with the notches 62*a* and 62*b* of the locking members 42 relatively separate from the notches 62*a* and 62*b*, respectively.

(4) The person continuously pulls the pull members 83 with his hands 97 substantially downward. The male hooks 56*a* and 56*c* inserted in the large-diameter lower holes 86 of the end lug holes 84*a* and 84*b* of the takeout member main bodies 82 relatively move forward to the small-diameter upper holes 85 of the end lug holes 84*a* and 84*b*, respectively.

(5) The person continuously pulls the pull members 83 with his hands 97 substantially downward. This causes the takeout member main bodies 82 (particularly their thick portions 88 and 87) to press-fit between the male hooks 56*a* and 56*c* and the female hooks 72 which correspond to the male hooks 56*a* and 56*c*. The male hooks 56*a* and 56*c* accordingly separate from the female hooks 72, respectively, and disengage from them.

(6). The person continuously pulls the pull members 83 with his hands 97 substantially downward. As the male hooks 56*a* and 56*c* respectively catch the thick portions 88 and 87 of the takeout member main bodies 82, the inside pads 38*a* and

38*b* pivot forward clockwise in FIG. 5 each about the male hook 56*b* (in other words, the female hook 72 corresponding to the male hook 56*b*) as the fulcrum. This extracts most (in other words, the front portions) of the inside pads 38*a* and 38*b* outwardly from inside the outer shell 31.

(7) Where necessary, the person strongly pulls the inside pads 38*a* and 38*b* or inserts the fingers of his hands 97 into portions between the impact-on-the-chin-and-cheek absorbing liner 37 and inside pads 38*a* and 38*b* to separate the male hooks 56*b* from the female hooks 72. The person then completely extracts the inside pads 38*a* and 38*b* from inside the outer shell 31.

(8) The person holds the head protecting cap portion 3 with his hands 97 and separates it from the head 11 of the helmet wearer 2. In this case, at least one of the blockish inside pads 38*a* and 38*b* for the cheeks is no longer in the head protecting cap portion 3 entirely or partly. Hence, the person can easily remove the head protecting cap portion 3 from the head 11 of the helmet wearer 2.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, each pull member 83 forms a loop. Alternatively, the pull member 83 may form a semi-loop member or simply a cord, or can form another pulling means, e.g., a substantially plate-like means, integrally formed with the takeout member main body 82.

In the above embodiment, the blockish inside pad which is to be extracted at least partly by the pad takeout member 81 from inside the head protecting cap portion 3 comprises the blockish inside pads 38*a* and 38*b* for the right and left cheeks. Alternatively, the blockish inside pad to be extracted may comprise an additional blockish inside pad for the forehead, or another existing or additional blockish inside pad.

In the above embodiment, the bag-like member 45 of the pad main body 41 of each of the blockish inside pads 38*a* and 38*b* for the cheeks comprises the pair of inner and outer holding members 53 and 54. However, the bag-like member 45 need not comprise the pair of holding members 53 and 54, and the entire bag-like member 45 may be formed of a flexible sheet member, as has been known. In this case, one or a plurality of hook attaching plates (not shown) to attach the male hooks 56*a* to 56*c* can attach to the bag-like member 45.

In the above embodiment, the three male hooks 56*a* to 56*c* are disposed on each of the blockish inside pads 38*a* and 38*b* for the cheeks. Alternatively, another number of male hooks 56*a* to 56*c* (accordingly the female hooks 72), e.g., two, or four or more, can be disposed on each of the inside pads 38*a* and 38*b*.

In the above embodiment, the pad takeout members 81 separate not all (more specifically, three) but some (more specifically, two) of the male hooks 56*a* to 56*c* disposed on each of the blockish inside pads 38*a* and 38*b* for the cheeks. The number of male hooks 56*a* to 56*c* to be separated by the pad takeout members 81 from the female hooks 72 may be all of the male hooks 56*a* to 56*c*, or conversely fewer than that of the above case (more specifically, two). In this case, the number of end lug holes 84*a* and 84*b* to be formed in each takeout member main body 82 can be changed to correspond to the number of male hooks 56*a* to 56*c*.

In the above embodiment, each of the engaging holes to be formed in each pad takeout member 81 to engage with the male hooks 56*a* to 56*c* comprises the end lug holes 84*a* and 84*b*. Alternatively, the engaging holes may be mere circular holes, vertically elongated elliptic holes, vertically elongated oval circles or the like.

In the above embodiment, the bag-like member 45 stores only one cushion member 44. Alternatively, two or more cushion members 44 may be stacked in a plurality of layers and stored in the bag-like member 45.

In the above embodiment, the engaging projections 56*a* to 56*c* of the recess-projection engaging mechanisms that detachably engage the plurality of holding members 53 and 54 with each other by recess-projection engagement also serve as the fitting projections of recess-projection fitting mechanisms that detachably recess-projection fit the inside pads 38*a* and 38*b* with the head protecting cap portion 3 when incorporating the inside pads 38*a* and 38*b* in the head protecting cap portion 3. Alternatively, the latter fitting projections may be separately provided on the outer holding member 54 or the like. The both of the projection-recess engaging mechanisms and recess-projection fitting mechanisms are not always necessary. In this case, other connecting mechanisms such as taping may replace the former projection-recess engaging mechanisms.

In the above embodiment, when the two holding members 53 and 54 connect to each other by recess-projection engagement, they overlie on each other such that one holding member 53 comes inside and the other holding member 54 comes outside. Alternatively, the two holding members 53 and 54 may overlie on each other such that one holding member 53 is partly inside and partly outside, and the other holding member 54 is partly outside and partly inside.

In the above embodiment, the engaging holes 61*a* to 61*c* are notched engaging holes. Alternatively, the engaging holes 61*a* to 61*c* may be independent engaging holes, e.g., substantially circular holes.

In the above embodiment, each of the holding members 53 and 54 forms a substantially yoked shape, and the holding members 53 and 54 respectively have the plurality of openings 55 and 57 to improve the elasticity and reduce the weight. However, each of the holding members 53 and 54 need not always form a yoked shape, and the openings 55 and 57 can be omitted where necessary.

In the above embodiment, the three tongue pieces 91 to 93 are provided. However, the number of tongue pieces 91 to 93 need not be three, and the tongue pieces 91 to 93 can be omitted.

In the above embodiment, the present invention is applied to the full-face-type helmet 1. The present invention can also be applied to a helmet of another type, e.g., jet type, semi-jet type or the like.

The invention claimed is:

1. A helmet comprising a head protecting cap portion with one or a plurality of blockish inside pads disposed therein, at least one blockish inside pad being attached to said head protecting cap portion by one or a plurality of recess-projection fitting mechanisms, at least one recess-projection fitting mechanism comprising a male hook disposed on said at least one blockish inside pad, and a female hook disposed on said head protecting cap portion to be able to recess-projection fit with said male hook, and pulling means for extracting said at least one blockish inside pad from inside said head protecting cap portion at least partly, said pulling means being pulled to extract said at least one blockish inside pad from inside said head protecting cap portion at least partly, wherein said helmet further comprises a pad takeout member including an interrupt portion capable of interrupting between said male hook and said female hook, which recess-projection fits with said make hook, and said pulling means, and when pulling said pulling means, said interrupt portion interrupts between said male hook and said female hook to disengage recess-projection fitting thereof, and is caught on said male hook, and said male hook is pulled out to outside said head protecting cap portion at least halfway to take out said at least one blockish inside pad from inside said head protecting cap portion at least partly.

2. A helmet according to claim 1, wherein said at least one blockish inside pad comprises any one of a blockish inside pad for a left cheek and a blockish inside pad for a right cheek.

3. A helmet according to claim 1, wherein said at least one blockish inside pad comprises a blockish inside pad for a left cheek and a blockish inside pad for a right cheek.

4. A helmet according to claim 1, wherein said pad takeout member comprises a takeout member main body including said interrupt portion and a pull member attaching to said takeout member main body.

5. A helmet according to claim 4, wherein said pull member comprises a substantially loop-shaped tape-like fabric cord.

6. A helmet according to claim 1, wherein said plurality of recess-projection fitting mechanisms attach said at least one blockish inside pad to said head protecting cap portion, and when pulling said pulling means, recess-projection fitting of at least another recess-projection fitting mechanism excluding one of said plurality of recess-projection fitting mechanisms is disengaged.

7. A helmet according to claim 6, wherein said recess-projection fitting mechanism comprises three recess-projection fitting mechanisms, and when pulling said pulling means, two interrupt portions disengage recess-projection fitting of two of said recess-projection fitting mechanisms, and said blockish inside pad pivots forward about remaining one of said recess-projection fitting mechanisms as a fulcrum toward outside said head protecting cap portion.

8. A helmet according to claim 1, wherein said pad takeout member comprises an engaging hole in which said male hook is to be inserted, said male hook inserted in said engaging hole of said pad takeout member is fitted with said female hook by recess-projection fitting, and said interrupt portion is provided around said engaging hole at least partly.

9. A helmet according to claim 8, wherein said engaging hole comprises an end lug hole.

10. A helmet according to claim 1, wherein said interrupt portion comprises a thick portion.

11. A helmet according to claim 10, wherein said thick portion is arcuate.

12. A helmet according to claim 1, wherein said blockish inside pad comprises at least one thick plate-like cushion member and a bag-like member which covers said cushion member like a bag, said bag-like member comprising a bag main body including an opening, through which said cushion member can be loaded and unloaded, in one surface thereof, and a plurality of holding members each of which is formed of a thin plate-like elastic material and covers said opening at least partly, part of an outer portion of each of said plurality of holding members attaching to said bag main body on part of a peripheral portion of said opening, and at least one engaging mechanism detachably engages said plurality of holding members with each other, said at least one engaging mechanism comprising said male hook provided to at least one of said plurality of holding members, and a second engaging hole formed in at least another one of said plurality of holding members to detachably engage with said male hook.

13. A helmet according to claim 12, wherein said second engaging hole comprises-a notched hole.

14. A helmet according to claim 12, wherein said male hook comprises three male hooks, and said second engaging hole comprises three engaging holes.

* * * * *